United States Patent [19]

Rutz

[11] 3,955,477

[45] May 11, 1976

[54] HYDROSTATIC PISTON MACHINE HAVING A GUIDE FOR LATERALLY GUIDING A CYLINDER BLOCK PINTLE

[75] Inventor: Peter Rutz, Winterthur, Switzerland

[73] Assignee: Sulzer Brothers Limited, Winterthur, Switzerland

[22] Filed: Nov. 14, 1974

[21] Appl. No.: 523,984

[30] Foreign Application Priority Data

Nov. 27, 1973 Switzerland ..... 16626/73

[52] U.S. Cl. ..... 91/497

[51] Int. Cl.[2] ..... F01B 13/06

[58] Field of Search ..... 91/497, 493–495, 91/491; 417/221; 92/12.1, 57

[56] References Cited

UNITED STATES PATENTS

| | | | |
|---|---|---|---|
| 2,674,195 | 4/1954 | Aluja | 91/497 |
| 2,827,859 | 3/1958 | Crane | 91/497 |
| 3,211,105 | 10/1965 | Bush et al. | 91/482 |
| 3,520,232 | 7/1970 | Tobias | 91/497 |
| 3,708,250 | 1/1973 | Thomm | 417/221 |
| 3,709,104 | 1/1973 | Colberson | 91/495 |
| 3,785,250 | 1/1974 | Steiger | 91/491 |

FOREIGN PATENTS OR APPLICATIONS

| | | | |
|---|---|---|---|
| 652,092 | 11/1946 | United Kingdom | 91/497 |

*Primary Examiner*—William L. Freeh
*Attorney, Agent, or Firm*—Kenyon & Kenyon Reilly Carr & Chapin

[57] ABSTRACT

The pintle is mounted at one end in a lever which is pivotal about an axis parallel to the pintle axis and guide member axis. In addition, a guide means is provided to laterally guide the lever and pintle within the casing during pivoting of the lever. The guide means includes various guide elements between the pintle and casing, lever and casing and the lever pivot and casing.

9 Claims, 2 Drawing Figures

Figure 1:
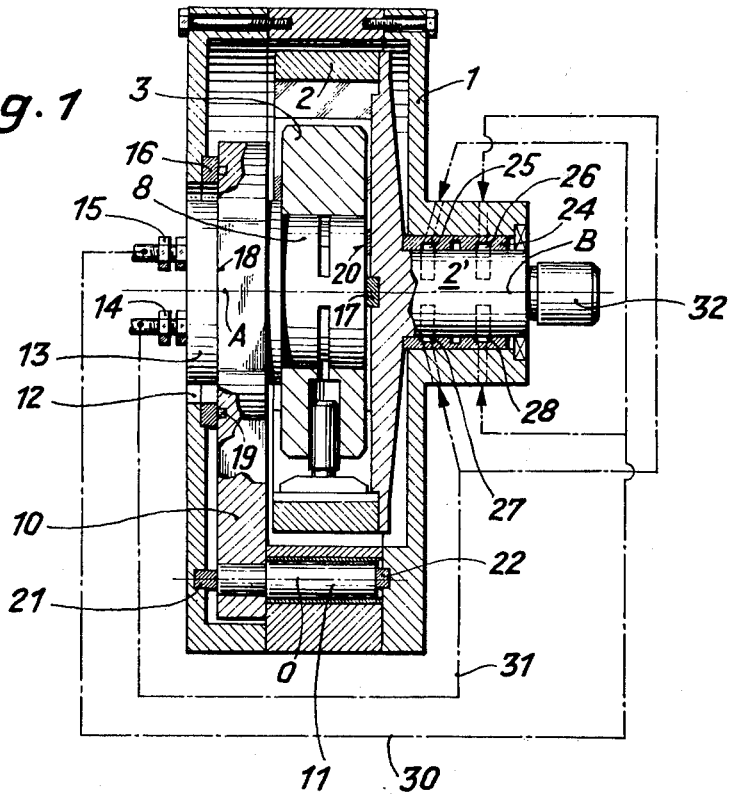

HYDROSTATIC PISTON MACHINE HAVING A GUIDE FOR LATERALLY GUIDING A CYLINDER BLOCK PINTLE

This invention relates to a hydrostatic piston machine.

As is known, hydrostatic piston machines generally have a cylinder block which is rotatable about a cylinder block pintle and in which pistons are guided and bear by their outer ends on a guide member rotatable in a casing about an axis parallel to the pintle axis. Usually, the pistons are distributed along the periphery of the cylinder block radially of the cylinder block pintle.

In hydrostatic piston machines of this kind, it has been known to adjust the throughput of a hydraulic medium to different values by altering the eccentricity of the cylinder block with respect to the guide member. To this end one of these parts is adjustable relative to the other along a guide so that the distance between the axis of the cylinder block pintle and the axis of the guide member is variable. However, the guide systems used for this purpose have usually been relatively complicated. In many cases, the guide systems have not been completely satisfactory since deformations of the adjusting mechanism are possible and these deformations can be transmitted to the cylinder block pintle.

Accordingly, it is an object of the invention to provide a hydrostatic piston machine with a simple means to enable the eccentricity of cylinder block pintle to guide member and, hence, the throughput volume of hydraulic medium to be varied.

It is another object of the invention to reduce deformations of an adjusting mechanism for moving a cylinder block cylinder of a hydrostatic piston machine to a minimum.

It is another object of the invention to maintain a parallel relationship between a cylinder block pintle and a rotatable piston guide member of a hydrostatic piston machine during changes in the eccentricity of the axes of the pintle and member.

Briefly, the invention provides a hydraulic piston machine having a casing, a cylinder block pintle, a cylinder block rotatably mounted on the pintle, pistons and a guide member rotatably mounted within the casing peripherally about the cylinder block. The pintle has a longitudinal axis which is parallel to the axis of the guide member and the pistons are movably mounted in the cylinder block radially of the pintle. Each piston has an outer end which bears on the guide member so that upon rotation of the guide member relative to the pintle, the pistons can be moved radially should the axes of the pintle and guide member be eccentric to each other. In addition, a lever is pivotally mounted in the casing about a third axis parallel to the pintle axis. This lever is secured to the pintle to move the pintle to relocate the pintle axis relative to the guide member axis. A guide means is also provided for laterally guiding the lever and pintle within the casing during pivoting of the lever about the lever axis.

In order to adjust the flowthrough of a hydraulic medium in the direction of flow, the lever is pivoted on its axis about a pivot in a plane perpendicular to the pintle axis. The pintle axis is thus caused to move, at least to one side, out of a position in which the pintle axis is situated on the guide member axis. The guide means serves to laterally guide the lever and pintle during this movement.

According to the invention, a dual guide is provided for adjustment of the cylinder block pintle. On the one hand, the lever is pivotable about its pivot while, on the other hand, the pivoting movement of the lever is laterally guided. This gives a simple adjusting mechanism which is nevertheless exposed to minimum deformation on loading by hydraulic forces acting on the cylinder block.

The guide means comprises disc-shaped guide elements disposed in the region of and at the two ends of the cylinder block pintle so that the lever and the end-face of the pintle bear against the guide elements. Also, the lever is simultaneously laterally supported in the region of its pivot between guide elements. The guide element disposed on that side of the lever which is remote from the cylinder block is a guide ring which encloses an aperture formed in the casing and through which that end of the cylinder block pintle which is remote from the cylinder block is accessible. This provides accurate lateral guidance of the lever in a simple manner.

Connections for the supply and discharge of hydraulic medium may be provided at the end of the pintle accessible via the aperture. This ensures a simple supply and discharge of the hydraulic pressure medium by means of hoses, which additionally have the advantage of not transmitting any vibrations occurring during operation and, in actual fact, have some damping action.

Figure 2:
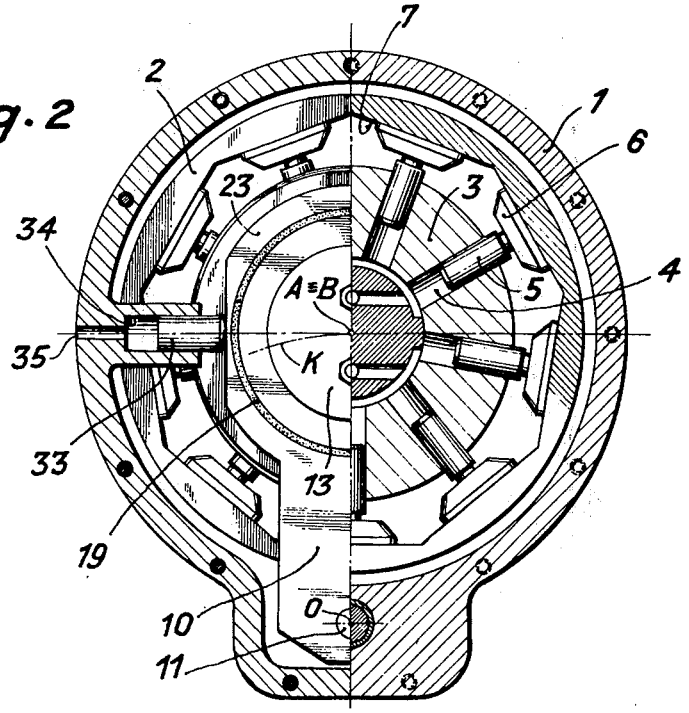

These and other objects and advantages of the invention will become more apparent from the following detailed description and appended claims taken in conjunction with the accompanying drawing in which:

FIG. 1 illustrates an axial section of a hydrostatic machine according to the invention; and FIG. 2 illustrates a cross-sectional view of the machine shown in FIG. 1. The left-hand half is a section substantially along the plane of the lever while the right-hand half is a section through the cylinder block.

The machine illustrated in FIGS. 1 and 2 can operate as a pump or as a motor. When operated as a pump, the delivery and direction of delivery can be altered, while when operated as a motor the torque and direction of rotation can be changed.

As shown in FIGS. 1 and 2, the hydraulic piston machine comprises a casing 1 in which a drum-shaped guide member 2 is mounted for rotation about an axis B. A cylinder block 3 in which pistons 5 are guided in radial cylinder bores 4 is provided inside the periphery of the guide member 2. Each of the pistons 5 has a foot 6 at the outer end with a plane bearing surface by which the piston is guided along a plane guide surface 7 of the guide member 2. The cylinder block 3 is mounted for rotation on a cylinder block pintle 8 which is mounted in the casing 1 on a longitudinal axis A.

A lever 10 is pivotally mounted in the casing 1 on a pivot 11 about an axis parallel to the pintle axis A. This lever 10 is secured at the free end to an end of the pintle 8 in order to move the pintle 8 to relocate the pintle axis A relative to the guide member axis B. The arrangement is such that the cylinder block pintle 8 is movable to both sides along an arc of a circle K out of a position in which the pintle axis A is situated on the axis B of the guide member 2 as shown. The center of the arc K is on the axis 0 of the pivot 11.

Still referring to FIGS. 1 and 2, casing 1 has an aperture 12 through which that end 13 of the pintle 8 which is remote from the cylinder block 3 is accessible. Connections 14, 15 are provided at the end 13 of pintle 8 for hoses for the supply and discharge of hydraulic medium.

A guide means is provided for laterally guiding the lever 10 and pintle 8 within the casing 1 during pivoting of the lever 10 laterally about the axis 0 of the pivot 11. This guide means includes a pair of disc-shaped guide elements 16, 17 each of which is disposed at an opposite end of the pintle 8. One guide element 16 is in the form of a ring having plane surfaces and is located in bearing relation between the casing 1 and a plane surface 18 of the lever 10. The other guide element 17 is in the form of a cylindrical disc and is located in bearing relation between a plane endface 20 of the pintle 8 and the guide member 2. The guide element 16 is also disposed about the aperture 12 of the casing 1 and acts as a sealing strip for the casing 1 in cooperation with a gasket 19 on the lever 10.

The guide means also includes a second pair of guide elements 21, 22 each of which is disposed between one end of the pivot 11 for the lever 10 and the casing 1. These guide elements 21, 22 are also in the form of cylindrical discs and bear against the endfaces of the pivot 11.

During an adjustment of the pintle axis A relative to the guide member axis B, the lever 10 is moved laterally, that is, perpendicularly of the guide member axis B while sliding via the surface 18 on the guide element 16. At the same time, the pintle 8 slides via the surface 20 on the guide element 17. The bottom end of the lever 10 is held between the guide elements 21, 22. Thus, deformation of the lever 10 which would result in the axis A of pintle 8 deviating from a parallel position to the axis B of the guide member 2, is prevented by the guide elements, particularly the large-radius ring 16.

As will be apparent from FIG. 2, lever 10 has an end portion 23 in the form of a plate for bearing on the annular guide member 16.

As will also be apparent from FIG. 1, the guide member 2 has a pivot 2' mounted in a bearing bush 24 which has hydrostatic pockets 25, 26, 27 and 28 and is secured in the casing 1. The bearing pockets 25–28 are connected crosswise to the connections 14 and 15 via conduits 30 and 31, in such a manner as to produce a supporting force in the bearing system to counteract the bending force of the overhung guide member 2. Thus, connection 14 is connected to the pockets 26 and 27 by the conduit 31 while connection 15 is connected to the pockets 25 and 28 via the conduit 30.

Referring to FIG. 1, the pivot 2' is provided with a shaft stub 32 for the supply or take-off of torque.

Referring to FIG. 2, a hydraulic piston means is provided in the casing 1 for adjustment of the lever 10 about the axis 0. This latter means comprises a piston 33 guided in sealing-tight relationship in a bore 34 formed in the casing 1. The bore 34 can be connected to a hydraulic pressure medium source (not shown) via a bore 35 for adjustment of the lever 10. An identical piston disposed on the other side of the lever 10 can cooperate with the piston 33, the pistons 33 simultaneously defining the position of the lever 10 by their position. Alternatively, a spring may simply be provided opposite the piston 33 and be compressed by the force of the piston and, in turn, press the lever 10 against the piston 33.

Although the supply and discharge of hydraulic pressure medium to and from the pintle 8 is carried out by means of hoses in the example illustrated, it is possible without difficulty to use, for example, elastic tubes instead of hoses. Suitable ducts and bores in the pivot 11 and in the lever 10 are also possible for the supply of hydraulic pressure medium.

What is claimed is:

1. A hydrostatic piston machine comprising a casing;

a cylinder block pintle mounted in said casing about a longitudinal axis;

a cylinder block rotatably mounted on said pintle;

a guide member rotatably mounted within said casing peripherally about said cylinder block on an axis parallel to said pintle axis;

a plurality of pistons movably mounted in said cylinder block radially of said pintle, each said piston having a foot at an outer end with a plane bearing surface bearing on a plane guide surface of said guide member;

a lever pivotally mounted in said casing about a third axis parallel to said pintle axis, said lever being secured to said pintle for moving said pintle to relocate said pintle axis relative to said guide member axis; and a guide means including a pair of disc-shaped guide elements for laterally guiding said lever and said pintle within said casing during pivoting of said lever about said third axis, each said guide element being disposed at an opposite end of said pintle with one guide element between said pintle and rotatable guide member and the other guide element between said lever and casing.

2. A hydrostatic piston machine as set forth in claim 1 further comprising a pivot secured to said guide member and rotatably mounted in said casing, and a stub shaft secured to said pivot.

3. A hydrostatic piston machine as set forth in claim 1 further comprising a hydraulic piston means in said casing for adjusting said lever about said third axis.

4. A hydrostatic piston machine as set forth in claim 1 which further comprises a pivot on said third axis pivoting said lever thereon and wherein said guide means further includes a second pair of guide elements, said guide elements each being disposed between one end of said pivot and said casing.

5. A hydrostatic piston machine as set forth in claim 1 wherein said disc-shaped guide element between said lever and casing is a guide ring and is disposed about an aperture in said casing, said pintle having an end remote from said cylinder block accessible to said aperture.

6. A hydrostatic piston machine as set forth in claim 5 which further comprises connections in said pintle end adjacent said aperture for supplying and discharging hydraulic medium to and from said pintle.

7. A hydrostatic piston machine as set forth in claim 5 which further comprises an annular seal between said guide ring and said lever for sealing said aperture to the exterior of said casing.

8. In a hydrostatic piston machine, the combination of a cylinder block pintle having a longitudinal axis, a guide member rotatably mounted peripherally about said cylinder block on an axis parallel to said pintle axis, a lever pivotally mounted about a third axis parallel to said pintle axis, said lever being secured at one end to an end of said pintle for moving said pintle axis relative to said guide member axis and a guide means for laterally guiding said lever and said pintle in perpendicular relation to said guide member axis during pivoting of said lever about said third axis, said guide means including a pair of guide elements, each said guide element being disposed at an opposite end of said pintle with one guide element between said pintle and rotatable guide member and the other guide element between said lever and casing.

9. A hydrostatic piston machine comprising:

a casing;

a cylinder block pintle mounted in said casing about a longitudinal axis;

a cylinder block rotatably mounted on said pintle;

a guide member rotatably mounted within said casing peripherally about said cylinder block on an axis parallel to said pintle axis;

a plurality of pistons movably mounted in said cylinder block radially of said pintle, each said piston having an outer end bearing on said guide member;

a lever pivotally mounted in said casing about a third axis parallel to said pintle axis, said lever being secured to said pintle for moving said pintle, relative to said guide member axis; and a pair of guide elements for laterally guiding said lever and said pintle within said casing during pivoting of said lever about said third axis, one of said elements being disposed between said pintle and said rotatable guide member and the other of said guide elements being disposed between said lever and said casing.

* * * * *